US008258897B2

(12) United States Patent
Patrick et al.

(10) Patent No.: US 8,258,897 B2
(45) Date of Patent: Sep. 4, 2012

(54) GROUND STRUCTURES IN RESONATORS FOR PLANAR AND FOLDED DISTRIBUTED ELECTROMAGNETIC WAVE FILTERS

(75) Inventors: Kevin W. Patrick, Tucson, AZ (US); Jeremy B. Baldwin, Sahuarita, AZ (US); Joel C. Blumke, Tucson, AZ (US); Sergio E. Cardona, Tucson, AZ (US); David J. Karasiewicz, Vail, AZ (US)

(73) Assignee: Raytheon Company, Waltham, MA (US)

( * ) Notice: Subject to any disclaimer, the term of this patent is extended or adjusted under 35 U.S.C. 154(b) by 308 days.

(21) Appl. No.: 12/728,007

(22) Filed: Mar. 19, 2010

(65) Prior Publication Data

US 2011/0227673 A1 Sep. 22, 2011

(51) Int. Cl.
*H01P 1/203* (2006.01)

(52) U.S. Cl. ..... 333/204

(58) Field of Classification Search ..... 333/203–205
See application file for complete search history.

(56) References Cited

U.S. PATENT DOCUMENTS

| | | | | |
|---|---|---|---|---|
| 5,066,933 | A * | 11/1991 | Komeda | 333/204 |
| 5,153,541 | A | 10/1992 | Johnson | |
| 5,311,159 | A * | 5/1994 | Miura et al. | 333/204 |
| 5,446,430 | A | 8/1995 | Yamanaka | |
| 5,621,365 | A | 4/1997 | Yamazaki | |
| 6,323,745 | B1 | 11/2001 | Toncich | |
| 6,483,404 | B1 * | 11/2002 | Ammar et al. | 333/204 |
| 6,566,988 | B2 * | 5/2003 | Muzutani et al. | 333/219 |
| 6,624,728 | B2 * | 9/2003 | Miyazaki et al. | 333/204 |
| 6,720,849 | B2 * | 4/2004 | Sasaki et al. | 333/204 |
| 6,750,741 | B2 * | 6/2004 | Mordkovich | 333/204 |
| 7,181,259 | B2 | 2/2007 | Tsuzuki | |
| 7,342,469 | B2 * | 3/2008 | Lee et al. | 333/204 |
| 2004/0036558 | A1 | 2/2004 | Allison et al. | |

FOREIGN PATENT DOCUMENTS

| | | | |
|---|---|---|---|
| JP | 2002335108 | A | 11/2002 |
| JP | 2003110317 | A | 4/2003 |

OTHER PUBLICATIONS

Ting-Yi Huang et al., "Design of miniaturized vertically stacked SIW filters in LTCC," Proceedings of the 39th European Microwave Conference, 2009, pp. 413-416.

* cited by examiner

*Primary Examiner* — Seungsook Ham
(74) *Attorney, Agent, or Firm* — Eric A. Gifford

(57) ABSTRACT

Coupling between non-adjacent resonators and wave propagation through the waveguide structure in distributed EM filters are reduced by forming one or more holes in one or more of the resonators (planar or folded) and by passing a conductive structure through each hole normal to the resonator. The conductive structures (vertical vias or horizontal strips) are preferably grounded, either by direct connection or capacitive coupling to one or more ground planes or by creation of a virtual ground. The holes are spaced apart from the edges of the resonator so as to minimize any interference with the current and fields concentrated at the edges of each resonator. These conductive structures narrow the effective cavity width "$a_{eff}$" for the waveguide as a whole and between non-adjacent resonators without affecting the cavity width "a" between adjacent resonators. Consequently the conductive structures have no effect on the desired coupling between adjacent resonators and the desired filter response of parallel-coupled filters while increasing the attenuation of the wave propagating in the waveguide and the attenuation of the wave coupled between non-adjacent resonators.

24 Claims, 9 Drawing Sheets

GROUND STRUCTURES IN RESONATORS FOR PLANAR AND FOLDED DISTRIBUTED ELECTROMAGNETIC WAVE FILTERS

BACKGROUND OF THE INVENTION

1. Field of the Invention

This invention relates to distributed electromagnetic wave filters and more particularly to ground structures formed in the resonators for planar and folded filters.

2. Description of the Related Art

A distributed element filter is an electromagnetic (EM) wave filter designed for frequencies between approximately 100 MHz to approximately 100 GHz and more typically between 500 MHz and 60 GHz. These bands may be referred to as RF or microwave. At these frequencies, the physical length of passive components is a significant fraction of the wavelength of the operating frequency, and it becomes difficult to use the conventional lumped element model. The distributed element model allows these components to be designed using transmission line theory better suited for these frequencies. These filters may be configured as lowpass, highpass, band pass or bandstop filters.

The filter is made up of one or more coupled resonators. A resonator oscillates at some frequency, called its resonance frequency, with greater amplitude than others. Selection of the number and design of individual resonators determines the nature of the filter response. The resonators may be grounded at either or both ends or left open. The wave may be coupled from one resonator to the next by direct-coupling in which a transmission line directly connects one resonator to the next or by parallel coupling in which the waves are coupled through the dielectric media (air or some other dielectric). The wave may be coupled into and out of the filter by any suitable means including direct-coupling or capacitive coupling. The filter may be configured in any one of many different toplogoies including, but not limited to, interdigital, comb-line, parallel-coupled line, hairpin parallel coupled line, short circuited quarter-wave stub band pass, open circuited quarter-wave stub band stop.

The filter may be configured as a microstrip or a stripline. A microstrip is made up of a conducting strip (the "resonator") separated from a ground plane by a dielectric layer (air or a dielectric material). A stripline is made up of a conducting strip (the "resonator") sandwiched between parallel ground planes separated by a dielectric (air or dielectric material). The conducting strip is typically but need not be equally spaced between the ground planes. The dielectric layer typically exhibits a uniform dielectric constant but may vary. The dimensions of the resonators and the cavity are on the order of the wavelength of the EM wave applied to and modified by the filter. For example, the resonators may have a length of one-quarter or one-half the center frequency wavelength ($\lambda$).

FIGS. 1*a* through 1*c* illustrate an embodiment of a 5-pole stripline bandpass filter 10. Four ¼$\lambda$ planar resonators 12*a* through 12*e* lie in a dielectric layer 14 equally spaced between an upper ground plane 16 and a lower ground plane 18 that define a cavity 20. In this embodiment each resonator has a length "l" and a width "w". The length "l" generally determines the center frequency of the filter and the width "w" (and thickness) generally determine the impedance. The resonators are connected to ground at one end to a side ground plane 21 and open at the other end. The cavity has a width "a" which is the resonator length "l" plus any additional unoccupied space and a length "s" which is the center-to-center spacing of the resonators. This spacing generally determines coupling of the electric field E 22 (and magnetic field M 24) between resonators. An electromagnetic wave 26 is coupled into the filter via an input 28 and is parallel-coupled from one resonator to the next and is coupled out of the filter as filtered wave 30 via an output 32. The propagation of the wave from one resonator to the next filters the wave according to the designed filter response (e.g. low pass, high pass, band pass or band stop).

However, the total filter response also includes undesirable components due to the coupling of the propagating wave between non-adjacent resonators and due to the propagating of the wave down the waveguide formed by the cavity and external ground planes. For an electromagnetic wave to propagate down a rectangular cross-section shaped cavity with minimal attenuation, the cavity has to be at least a half wavelength wide. If the cavity is less than a half wavelength wide, the wave will still propagate down the cavity but it will be attenuated according to $\alpha=(L*27.2875/a)*SQRT(1-\epsilon_r*(2*a/\lambda_0)^2)$ dB where $\alpha$ is the attenuation for a given length L of transmission line or cavity, L is the length of the transmission line or cavity, $\lambda_0$ is the wavelength of the wave, $\epsilon_r$ is the relative dielectric constant of the dielectric material in the cavity and a is the cavity width. For a given filter design the cavity width "a" may be such that the attenuation of the wave travelling down the waveguide and the attenuation of the wave coupled between non-adjacent resonators is not sufficient to effectively eliminate these components from the total filter response. Standard filter design tools assume these undesirable components are zero. Therefore, their existence not only affects the filter response in a negative manner but also in a manner not predicted by the design.

FIG. 2 illustrates the same 5-pole bandpass stripline filter in a "folded" resonator configuration. Resonator 12*a* (and each of the resonators) is folded in a plane normal to the upper and lower ground planes 16 and 18. An internal ground plane 34 suitably separates the upper and lower planar segments 36 and 38 of resonator 12*a*, which are connected by a vertical segment 40. The cavity width "a" is largely unaffected as it determined primarily by the unfolded length "l" of resonator 12*a*. Folding of the resonators is done to reduce the overall footprint of the filter. Vertical folding was proposed, for example by Japanese Patent Laid-Open Nos. 5-152,815/1993 and 5-175,702/1993 and by U.S. Pat. No. 5,621,365.

Folding does however negatively affect the performance of the filter. For an EM wave to be stimulated into a waveguide with width "a" there needs to be a vertical component in the waveguide. In a planar resonator structure there are no vertical components so the EM wave is more difficult to stimulate. Only the imperfections in the physical structure actually produce the unwanted wave. In the folded resonator configuration the vertical segment serves to better stimulate the propagation of the EM wave through the waveguide structure. This in turn increases the undesirable components attributable to waveguide propagation and coupling between non-adjacent resonators.

FIG. 3 illustrates a designed passband response 42 for a 5-pole bandpass filter. The achieved passband response 44 for the planar configuration has a wider "skirt flare" (less attenuation outside the passband) than desired. The achieved passband response 46 for the folded configuration is markedly worse. A designer may have to add resonators ("poles") to achieve, if possible, the desired response. Additional resonators increases insertion loss, reduces the quality factor and increases the size of the filter.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides distributed electromagnetic wave filters with reduced coupling between non-adjacent resonators and reduced wave propagation through the waveguide structure. The achieved filter response is attributable to the desired coupling between adjacent resonators and closely matches the designed filter response.

This is accomplished by forming one or more holes in one or more of the resonators (planar or folded) and by passing a conductive structure through each hole normal to the resonator. The conductive structures (vertical vias or horizontal strips) are preferably grounded, either by direct connection or capacitive coupling to one or more ground planes or by creation of a virtual ground. The holes are spaced apart from the edges of the resonator so as to minimize any interference with the current and fields concentrated at the edges of each resonator. These conductive structures narrow the effective cavity width "$a_{eff}$" for the waveguide as a whole and between non-adjacent resonators without affecting the cavity width "a" between adjacent resonators. Consequently the conductive structures have no effect on the desired coupling between adjacent resonators and the desired filter response of parallel-coupled filters while increasing the attenuation of the wave propagating in the waveguide and the attenuation of the wave coupled between non-adjacent resonators. In a direct-coupled filter topology, additional conductive structures may be placed between the resonators to effectively reduce the between resonator cavity width as well so that the filter response is determined by the directly coupled wave.

In an embodiment, a distributed electromagnetic (EM) wave filter comprises upper and lower ground planes on top and bottom surfaces of a cavity. The upper and lower ground planes are in electrical contact held at a single ground. One or more resonators in the cavity between the upper and lower ground planes define respective transmission lines. An input port is coupled to a first one of the one or more resonators to receive an EM wave and an output port is coupled to a last one of the one or more resonators to output a filtered EM wave. One or more holes are formed in one or more of the resonators. One or more conductive structures pass through the one or more holes substantially normal to the one or more resonators.

In another embodiment, a distributed electromagnetic (EM) wave filter comprises upper and lower ground planes on top and bottom surfaces of a cavity. The upper and lower ground planes are in electrical contact held at a single ground. One or more parallel-coupled planar resonators in the cavity between and in parallel with the upper and lower ground planes define respective transmission lines. An input port is coupled to a first one of the one or more resonators to receive an EM wave and an output port is coupled to a last one of the one or more resonators to output a filtered EM wave. One or more holes are formed in one or more of the planar resonators. One or more conductive vias connected at opposite ends to the upper and lower ground planes pass through the one or more holes substantially normal to the one or more resonators.

In another embodiment, a distributed electromagnetic (EM) wave filter, comprises upper and lower ground planes on top and bottom surfaces of a cavity. The upper and lower ground planes are in electrical contact held at a single ground. One or more parallel-coupled folded resonators in the cavity between and normal to the upper and lower ground planes define respective transmission lines. Each folded resonator comprises at least first and second planar segments opposed to each other in a spaced apart relationship and a vertical segment that connects one end of the first planar segment to one end of the second planar segment. An input port is coupled to a first one of the one or more resonators to receive an EM wave and an output port is coupled to a last one of the one or more resonators to output a filtered EM wave. One or more holes are formed in one or more of the first or second planar segments or the vertical segment of said resonators. One or more conductive structures pass through the one or more holes substantially normal to the respective segments of the resonators. The conductive structures passing through holes in the first and second planar segments are suitably vertical vias that are connected at opposite ends to the upper and lower ground planes and may be connected to an internal ground plane between the segments. The conductive structures pass through holes in the vertical segment are suitably planar strips that may be connected at opposite ends to an internal ground plane between the first and second planar segments and an external side ground plane.

These and other features and advantages of the invention will be apparent to those skilled in the art from the following detailed description of preferred embodiments, taken together with the accompanying drawings, in which:

DETAILED DESCRIPTION OF THE INVENTION

The present invention describes distributed electromagnetic wave filters with reduced coupling between non-adjacent resonators and reduced wave propagation through the waveguide structure. This is accomplished by forming one or more holes in one or more of the resonators (planar or folded) and by passing a conductive structure through each hole normal to the resonator. The conductive structures (vertical vias or horizontal strips) are preferably grounded, either by connection to one or more ground planes, capacitive coupling to a ground plane or by creation of a virtual ground. The holes are spaced apart from the edges of the resonator so as to minimize any interference with the current and fields concentrated at the edges of each resonator. These conductive structures narrow the effective cavity width "$a_{eff}$" for the waveguide as a whole and between non-adjacent resonators without affecting the cavity width "a" between adjacent resonators. Consequently the conductive structures have no effect on the desired coupling between adjacent resonators and the desired filter response of parallel-coupled filters while increasing the attenuation of the wave propagating in the waveguide and the attenuation of the wave coupled between non-adjacent resonators. In a direct-coupled filter topology, additional conductive structures may be placed between the resonators to effectively reduce the between resonator cavity width as well so that the filter response is determined by the directly coupled wave. The elimination or substantial reduction of undesired (and undesigned for) waveguide propagation and coupling between non-adjacent resonators both improves the actual filter response and closely matches the actual filter response to the designed filter response.

As will be appreciated by those skilled in the art, the proposed conductive structures within and normal to the individual resonators are generally applicable to any distributed element EM wave filter regardless of the transmission line (microstrip or stripline), I/O configuration, coupling between resonators (parallel or direct), resonator geometry (planar or folded), resonator topology (interdigital, comb-line, etc.) or filter response (bandpass, bandstop, low pass or high pass). The elimination or substantial attenuation of coupling between non-adjacent modes that are not considered during the filter design has the desired effect of having the realized filter response closely match the designed filter response. The number and placement of the conductive structures will depend on the specifics of a particular filter design.

Figure 1A:
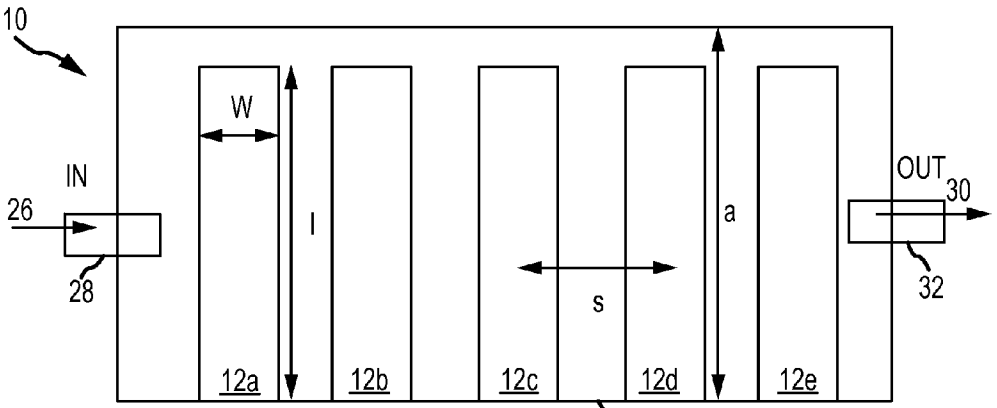
FIG.1a (PRIOR ART)
FIGS. 1*a* through 1*c*, as described above, are plan, end and side views of a 4-pole stripline bandpass filter with planar resonators.
Figure 1B:
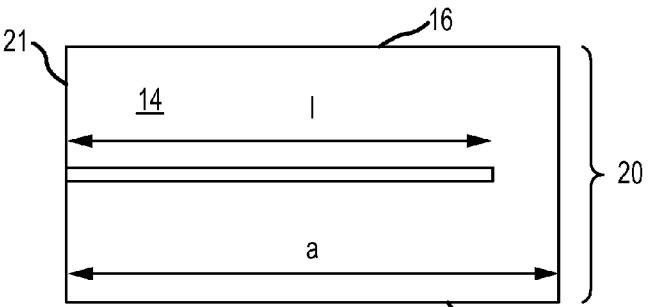
FIG.1b (PRIOR ART)
Figure 1C:
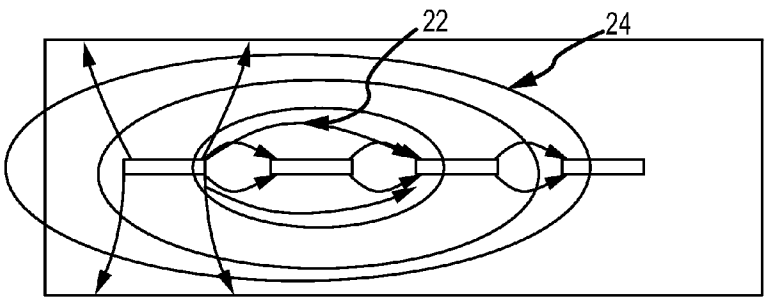
FIG.1c (PRIOR ART)
Figure 2:
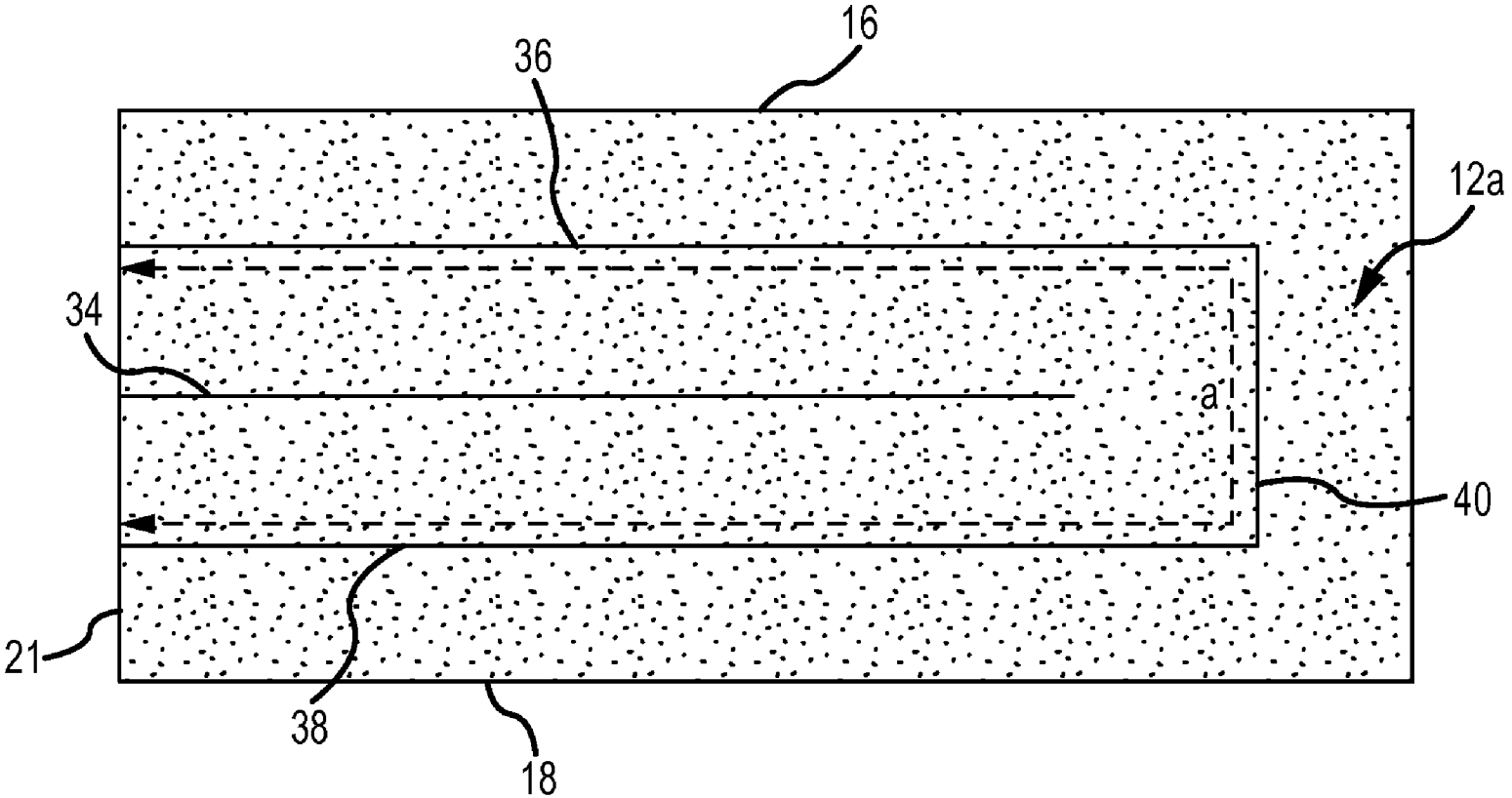
FIG.2 (PRIOR ART)
FIG. 2, as described above is an end view of the 5-pole stripline bandpass filter with folded resonators.
Figure 3:
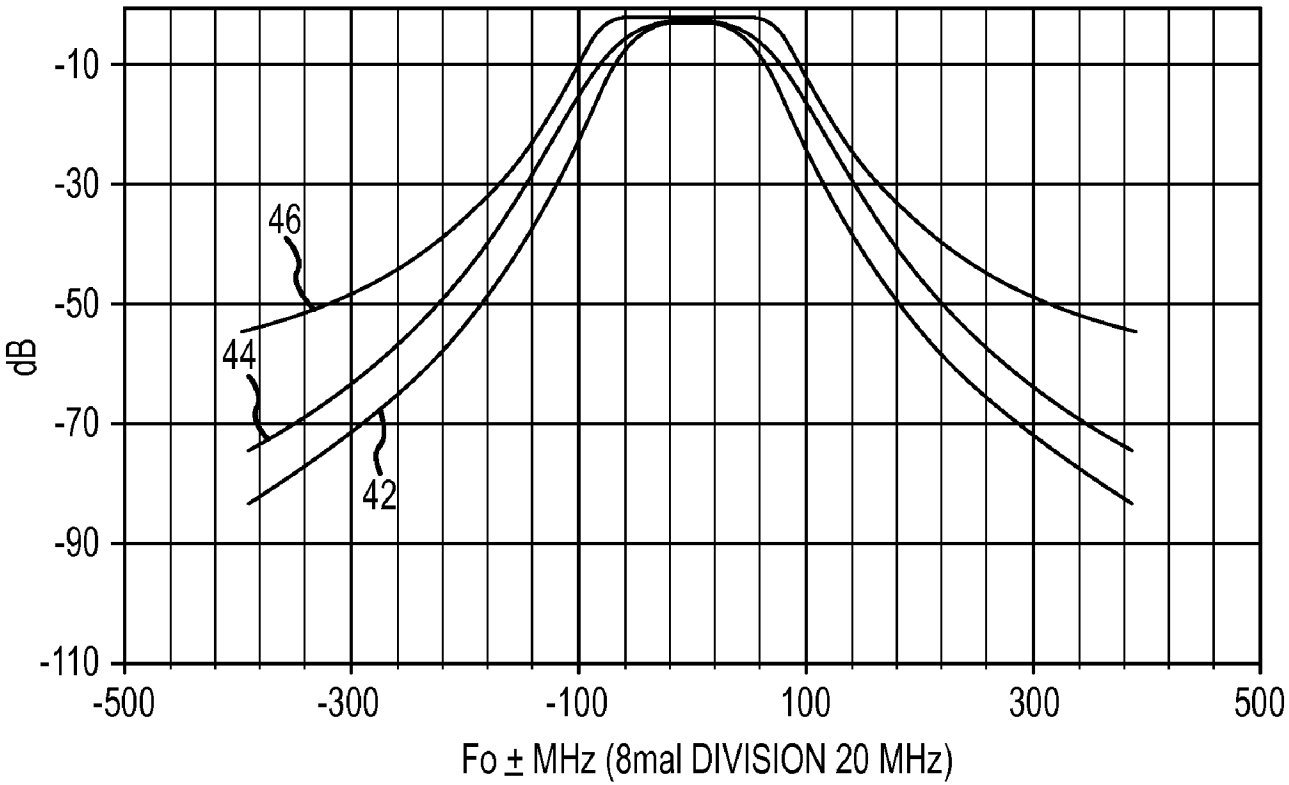
FIG.3 (PRIOR ART)
FIG. 3, as described above, is a plot of a designed 5-pole bandpass response and an actual bandpass response including skirt flare attributable to waveguide propagation and coupling between non-adjacent resonators.
Figure 4A:
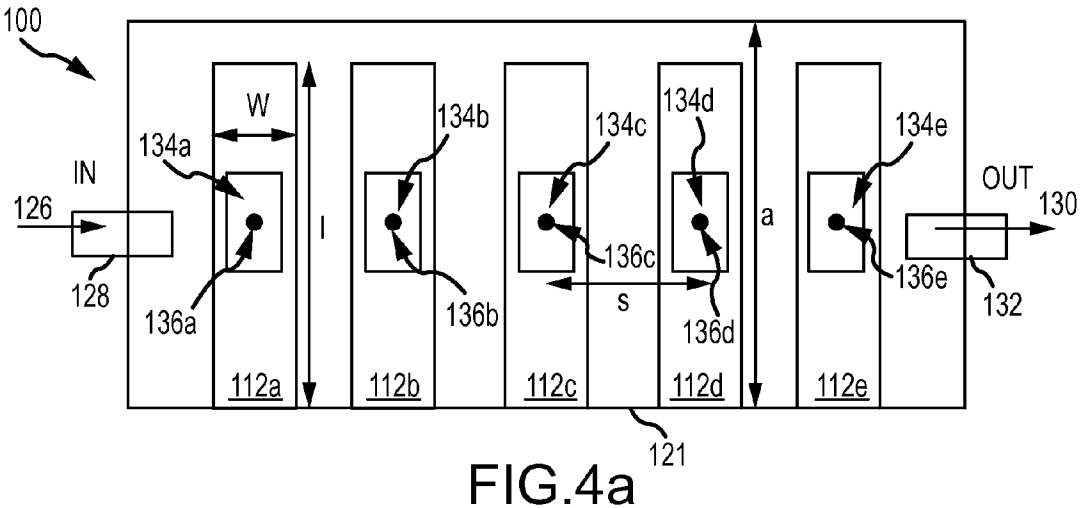
FIGS. 4*a* through 4*c* are plan, end and side views of a 5-pole planar parallel-coupled stripline bandpass filter including ground structures.
Figure 4B:
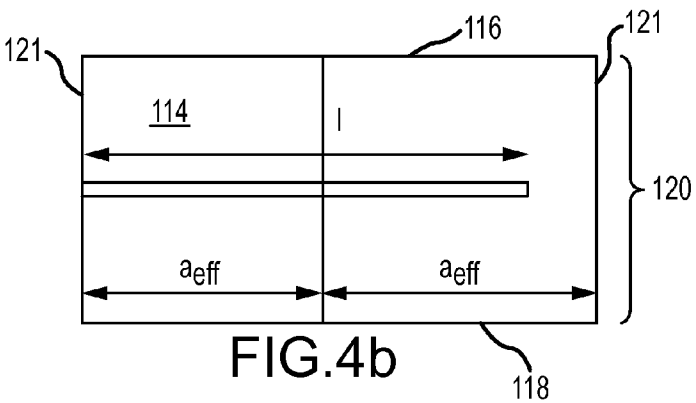
Figure 4C:
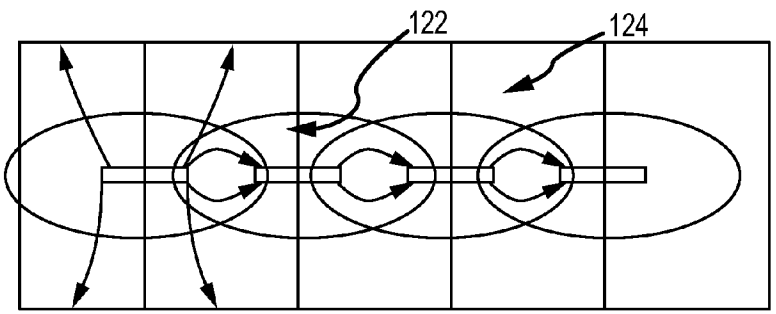

An embodiment of a distributed electromagnetic (EM) wave filter 100 comprising conductive structures that reduce coupling between non-adjacent resonators is illustrated in FIGS. 4*a* through 4*c*. This particular filter is a 5-pole stripline bandpass filter comprising parallel-coupled ¼λ planar resonators that are grounded at one end and open at the other. Essentially the same filter shown in FIGS. 1*a* through 1*c* but adding the conductive structures in accordance with an embodiment of the invention.

Four planar resonators 112*a* through 112*e* lie in a dielectric layer 114 (air or other dielectric material) equally spaced between an upper ground plane 116 and a lower ground plane 118 that define a cavity 120. In this embodiment each resonator has a length "l" and a width "w". The length "l" generally determines the center frequency of the filter and the width "w" (and thickness) generally determine the impedance. The resonators are connected to ground at one end to a side ground plane 121 and open at the other end. Another side ground plane 121 is suitably formed on the other side of the cavity opposite the open end of the resonators. All of the ground planes are in electrical contact held at a single ground. The cavity has a width "a" which is the resonator length "l" plus any additional unoccupied space and a spacing "s" which is the center-to-center spacing of the resonators. This spacing generally determines coupling of the electric field 122 (and magnetic field 124) between resonators. An electromagnetic wave 126 is coupled into the filter via an input 128 and is parallel-coupled from one resonator to the next and is coupled out of the filter as filtered wave 130 via an output 132. The propagation of the wave from one resonator to the next filters the wave according to the designed filter response (e.g. low pass, high pass, band pass or band stop). This particular 5-pole design imparts a band pass response to the wave.

Holes 134*a*, 134*b*, 134*c*, 134*d* and 134*e* are formed in resonators 112*a*, 112*b*, 112*c*, 112*d* and 112*e*, respectively. Conductive vias 136*a*, 136*b*, 136*c*, 136*d* and 136*e* pass through holes 134*a*, 134*b*, 134*c*, 134*d* and 134*e*, respectively, substantially normal to resonators 112*a*, 112*b*, 112*c*, 112*d* and 112*e*, respectively. Conductive vias 136*a*, 136*b*, 136*c*, 136*d* and 136*e* are terminated at the upper and lower ground planes 116 and 118, respectively. Alternately, the vias could extend through and beyond the ground planes by ¼λ to create virtual grounds at the walls of the cavity. The holes are sized so that they are small enough as not to interfere with the current and fields concentrated along the edges of the resonators and large enough to minimize capacitive coupling between the vias and the resonators. With a single hole/via pair per resonator, the hole/via pair may suitably be placed at the midpoint of the cavity, slightly offset from the midpoint of the resonator. For the waveguide as a whole and for non-adjacent resonators this effectively cuts the width of the cavity in half so that roughly aeff≅(½)*a. The vias have no effect on adjacent resonators so the effective width remains as "a". If the vias are not grounded they may still reduce the effective width of the cavity but the effect will not be as pronounced.

In a microstrip filter, the resonators 112*a*, 112*b*, 112*c*, 112*d* and 112*e* and lower ground plane 118 may be formed on opposite sides of a dielectric substrate. The upper ground plane 116 is placed at a much greater distance above the resonators so that it is not part of the transmission line. The upper ground plane may, for example, be a conductive lid for a filter package that is connected to the lower ground plane. The vias 136*a*, 136*b*, 136*c*, 136*d* and 136*e* may be terminated at the upper and lower ground planes and pass through the holes in the respective resonators. These vias might actually be screws or pieces of wire that are inserted into the filter structure. This might be necessary because the space between the microstrip structure and the lid may be air so a plated via cannot exist in the air dielectric.

Figure 5:
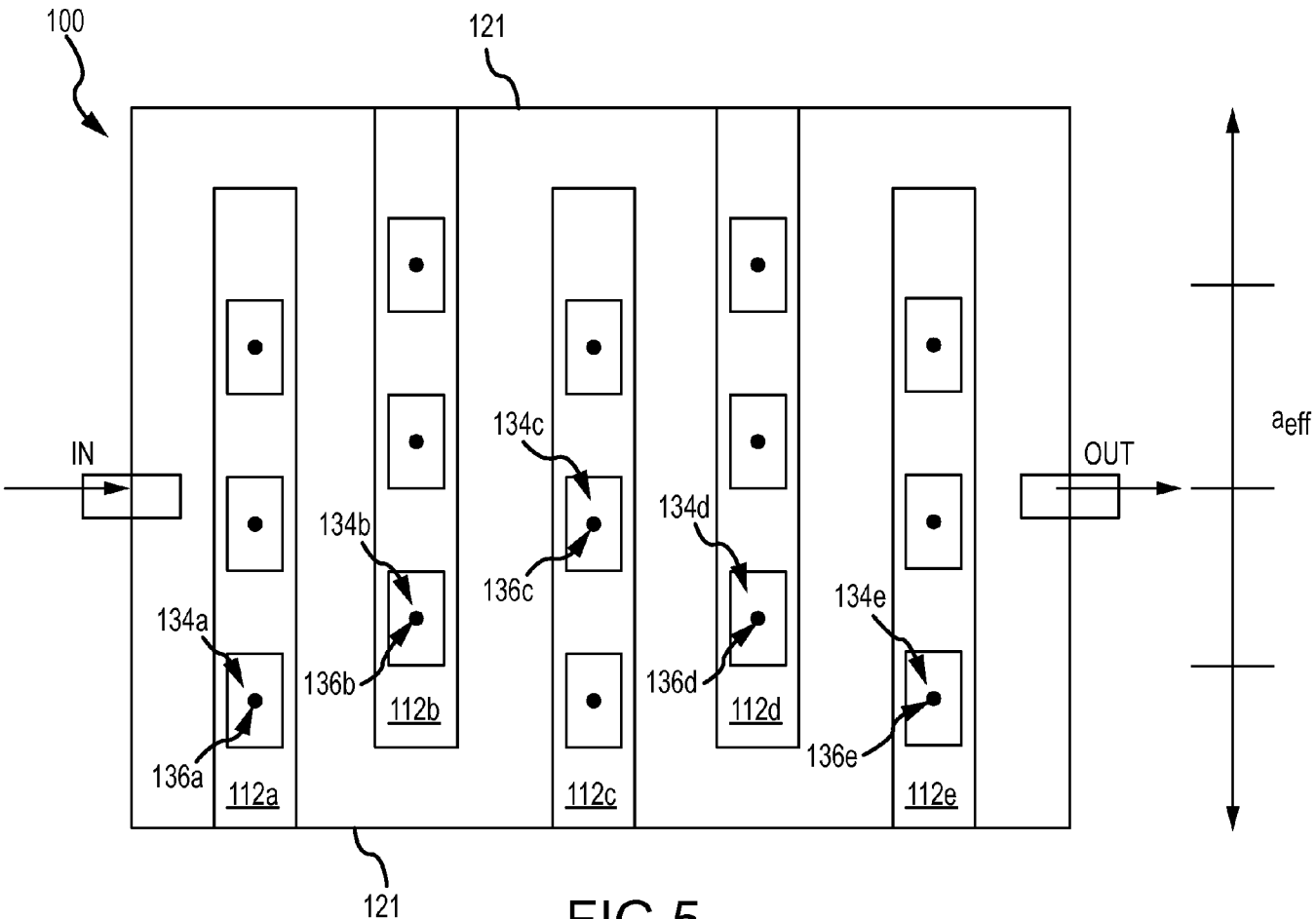
FIG. 5 is a plan view of another embodiment of multiple ground structures within each resonator.

FIG. 5 is an illustration of another embodiment of the 5-pole stripline bandpass filter 100. The five parallel-coupled ¼λ planar resonators 112*a* through 112*e* are still grounded at one end to a side ground plane 121 and open at the other but the grounded end alternates from one resonator to the next. In this embodiment, each resonator is provided with three hole/via pairs 134*a*/136*a*, 134*b*/136*b* etc. that are spaced along the length of the resonator. This effectively cuts the width of the cavity by a fourth so that roughly aeff≅(¼)*a. Again, the vias have no effect on adjacent resonators so the resonator effective width remains as "a"

Figure 6:
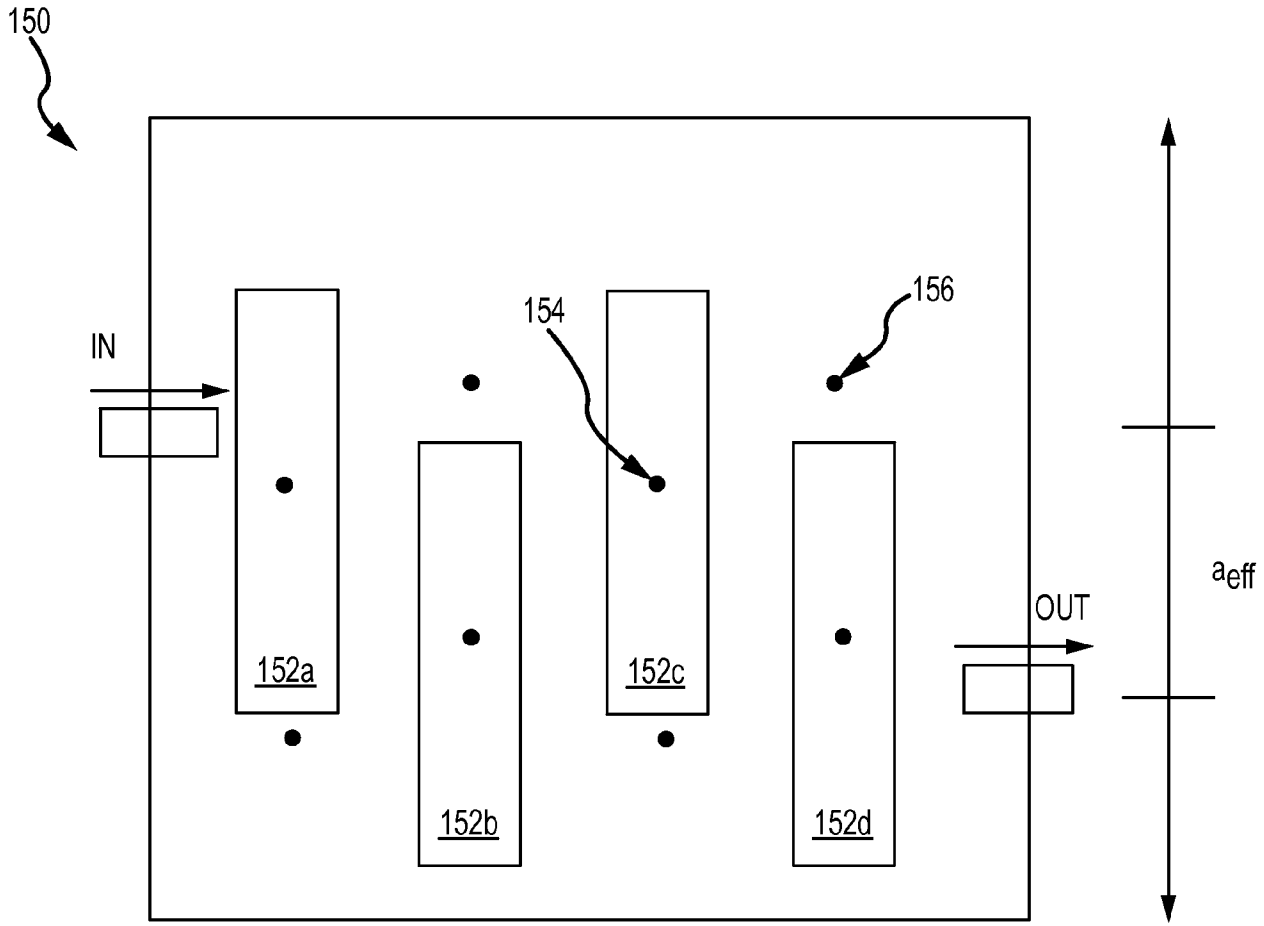
FIG. 6 is a plan view of another embodiment of a conductive via formed within the resonator at a virtual ground and ground structures outside the planar resonators.

FIG. 6 is an illustration of a 4-pole stripline bandpass filter 150. The filter comprises offset parallel-coupled ½λ planar resonators 152*a*-152*d* that are open at both ends. Ground vias 154 are suitably placed at the midpoint of the resonators. Because the resonators are half-wave resonators the midpoint will correspond to a virtual ground. Therefore the ground vias 154 may be contact directly to the resonators at the virtual ground. Other resonator structures may also exhibit virtual grounds at different positions. The ground vias 154 are suitably also connected to the upper and lower ground planes. Additional ground vias 156 are also positioned between non-adjacent resonators but not within a resonator. In this case, the cavity width may, for example, be roughly cut into thirds.

Figure 7:
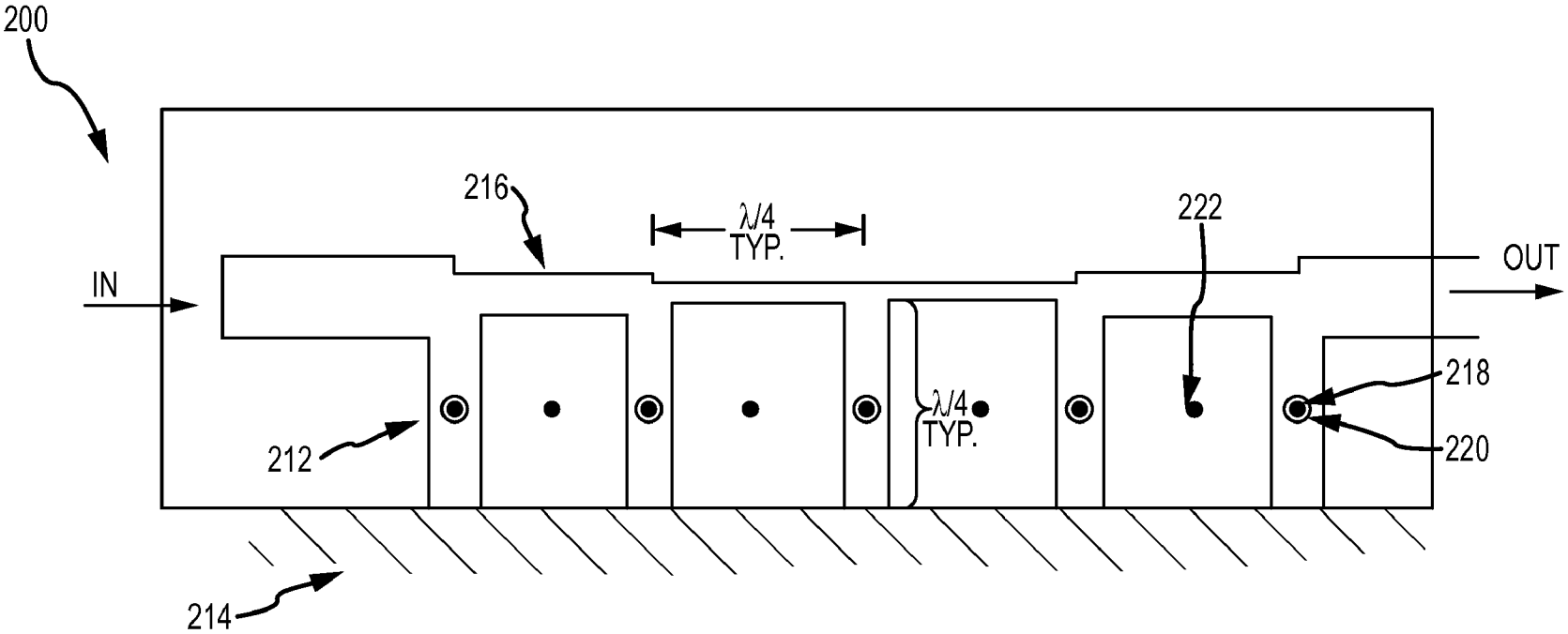
FIG. 7 is a plan view of an embodiment of a planar direct-coupled filter including ground structures both inside and outside the planar resonators.

FIG. 7 is an illustration of a 5-pole short-circuited quarter-wave stub band pass filter 200. The filter comprises quarter-wave resonators 212 that are each connected to a ground plane 214 and are direct-coupled to each other by quarter-wave transmission lines 216. In this case all wave propagation through the cavity albeit through the waveguide structure, between adjacent resonators or between non-adjacent resonators is undesirable. The desire wave propagation is through transmission lines 216 from one resonator to the next. Ground vias 218 formed through holes 220 in the resonators and terminated at ground, suitably the upper and lower ground planes, reduce coupling between non-adjacent resonators. Ground vias 222 between resonators and terminated at ground, suitably the upper and lower ground planes, reduce coupling between adjacent resonators. Both sets of ground vias increase attenuation of the wave in the waveguide structure.

Figure 8B:
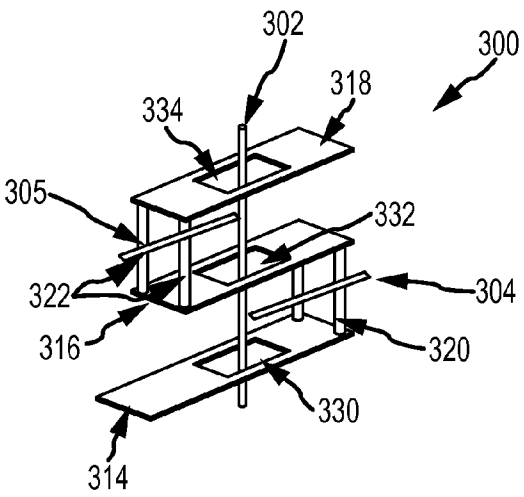
FIGS. 8*a* through 8*c* are end, perspective and unfolded views of a folded resonator including both vertical via and horizontal strip ground structures.
Figure 8A:
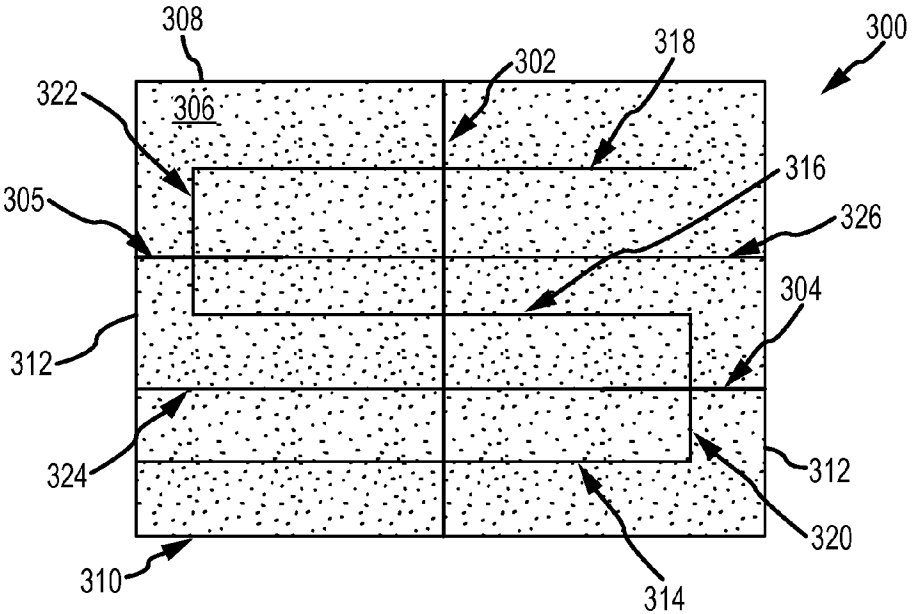
Figure 8C:
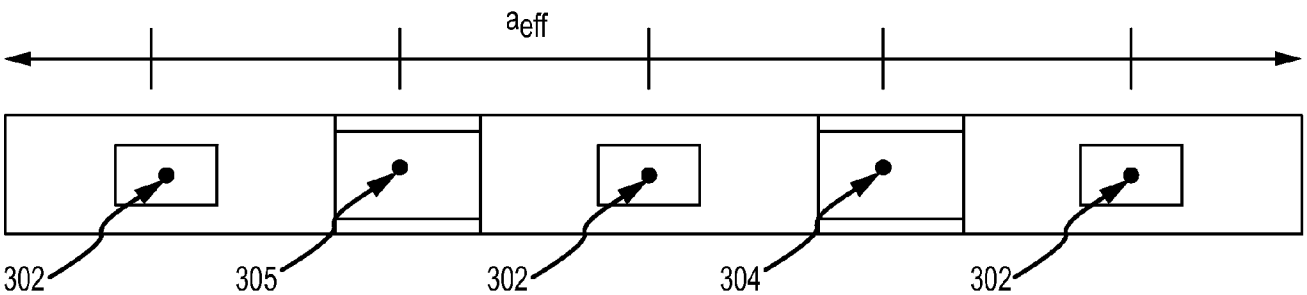

FIGS. 8*a* through 8*c* illustrate a folded resonator 300 in a stripline filter comprising both vertical vias 302 and horizontal strips 304, 305 ground structures. The filter includes a cavity 306 such as an air cavity or a laminated dielectric media. Upper and lower ground planes 308 and 310 and side ground planes 312 on the surfaces of the cavity define a waveguide structure. Folded resonator 300 lies in a plane normal to the upper and lower ground planes 308 and 310 and parallel to side ground planes 312 Folded resonator 300 comprises first, second and third planar segments 314, 316, and 318, respectively opposed to each other in a spaced part relationship at different layers in the dielectric media. In this embodiment, first segment 314 contacts side ground plane 312. A first vertical segment comprised of a pair of vias 320 connects the open end of first planar segment 314 to an end of second planar segment 316. A second vertical segment comprised of a pair of vias 322 connects the other end of second planar segment 316 to an end of third planar segment 318. In this embodiment, the other end of third planar segment 318 is left open. This particular resonator has n=2 two folds. The resonators may have a 0-step fold, n=1 fold or more folds. The cavity width "a" is the unfolded length of all the segments of the resonator plus any open space at the end of the resonator. To improve isolation of the planar segments of the resonator, internal ground planes 324 and 326 are formed inside the cavity equidistance between the first and second planar segments 314 and 316 and the second and third planar segments 316 and 318, respectively. The internal ground planes 324 and 326 contact side ground planes 312 so that all ground planes are held at a single ground.

Holes 330, 332 and 334 are formed in the first, second and third planar segments 314, 316 and 318, respectively. In this embodiment the holes are positioned so that a single vertical via 302 can pass through all three holes. Alternately, three separate vias at different positions along the resonators may be used. Or multiple aligned holes and vias may be formed along the length of the resonator to more finely divide the cavity. The vertical via 302 is terminated at the upper and lower ground planes 308 and 310 and at the internal ground planes 324 and 328. It is not necessary to terminate the via at each of the ground planes. The via could be terminated at one or more of the ground planes. The via may not be terminated at any of the ground planes but made to extend a quarter-wave past at least one of the upper and lower ground planes to provide a virtual ground at the wall of the cavity. The via may be allowed to float, although grounding the via will be more effective at reducing the effective cavity length.

Horizontal strips 304 and 305 extend through the holes formed between via pairs 320 and 322, respectively. Horizontal strip 304 is terminated between internal ground plane 324 at one end and side ground plane 312 at the other end. Horizontal strip 305 is terminated between internal ground plane 326 at one end and side ground plane 312 at the other end. The horizontal strip may not be terminated at any of the ground planes but made to extend a quarter-wave past the side lower ground plane to provide a virtual ground at the cavity wall. The strip may be allowed to float, although grounding the strip will be more effective at reducing the effective cavity length.

As shown in FIG. 8*c*, the combination of vertical vias 302 and horizontal strips 304, 305 reduce the effective cavity width roughly aeff≅(⅓)*a from the perspective of a wave traveling through the waveguide structure formed by the cavity and external ground planes or a wave coupling between non-adjacent resonators. Again, the vias and strips within the resonators do not affect the cavity width for coupling waves between adjacent resonators. In a given design for a folded resonator, one could use only vertical vias, only horizontal strips or a combination of both.

Figure 9:
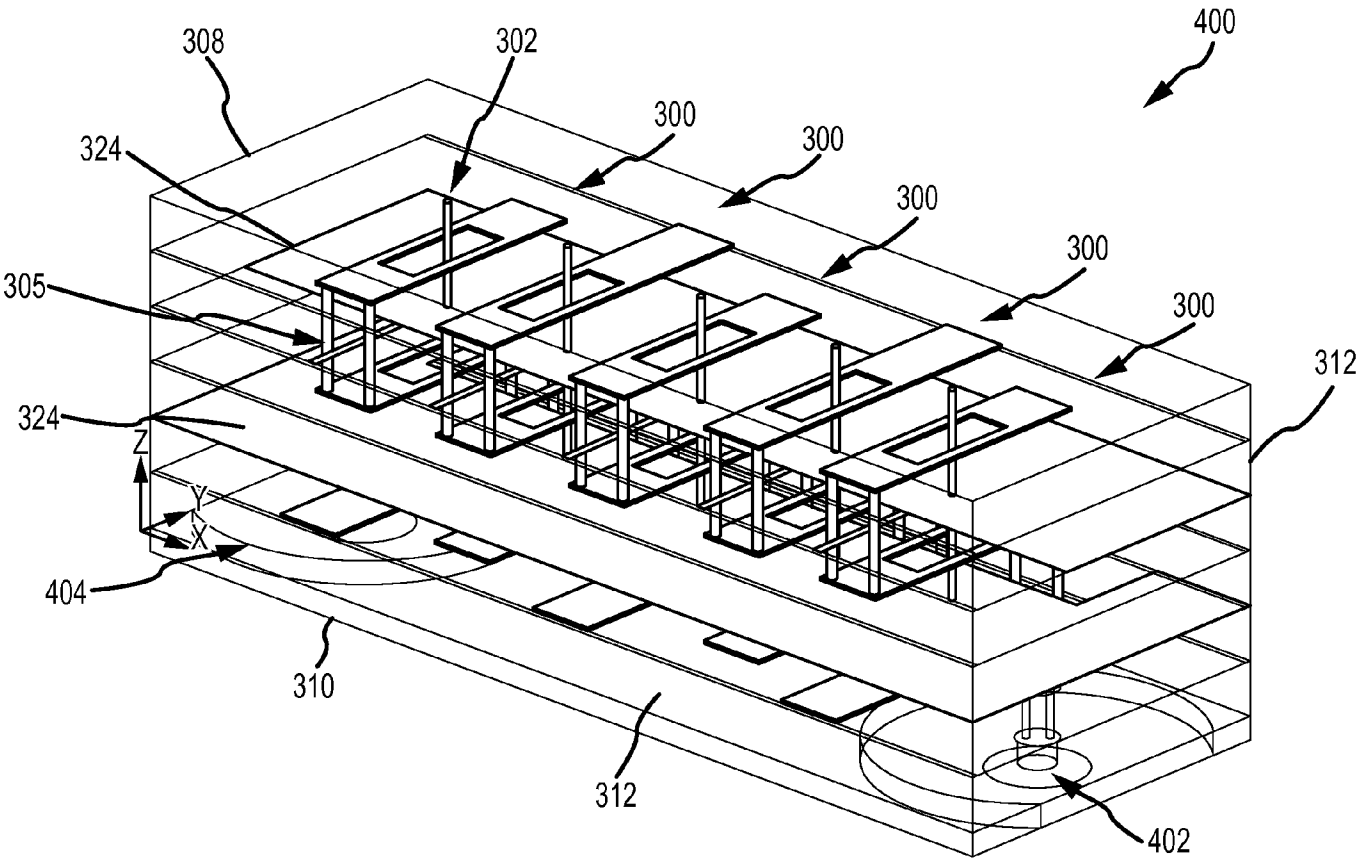
FIG. 9 is a perspective view of a 5-pole folded parallel-coupled stripline bandpass filter including both vertical via and horizontal strip ground structures.

FIG. 9 illustrates a 5-pole stripline bandpass filter 400 comprising parallel-coupled ¼λ folded resonators 300 of type shown in FIG. 8 that are grounded at one end and open at the other. As arranged, the resonators 300 alternate which end is terminated at side ground plane 312.

Filter 400 comprises upper and lower ground planes 308 and 310 on top and bottom surfaces of a cavity 306 and side ground planes 312 on opposing sides of the cavity. The upper, lower and side ground planes are in electrical contact held at a single ground. Five parallel-coupled folded resonators 300 in the cavity between and normal to the upper and lower ground planes define respective transmission lines. An input port 402 is coupled to a first resonator to receive an EM wave and an output port 404 is coupled to a last resonator to output a filtered EM wave. Vias 302 pass through holes in the planar segments of the resonators and are terminated at the upper and lower ground planes and internal ground planes 324 and 326. Horizontal strips 304 and 305 pass through the vertical folding vias that connect the planar segments of the resonators and are terminated at the internal ground planes 324 and 326, respectively, and the side ground planes 312. The vertical via and horizontal strip ground structures reduce the effective cavity width from the perspective of a wave traveling through the waveguide structure formed by the cavity and external ground planes or a wave coupling between non-adjacent resonators. Again, the vias and strips within the resonators do not affect the cavity width for coupling waves between adjacent resonators. This substantially reduces if not eliminates the undesirable components of the wave propagating through the waveguide structure or coupling between non-adjacent resonators without affecting the filter response of the parallel-coupled folded resonators. This both improves filter response and closely matches the actual filter response to the designed filter response that does not consider these undesirable components.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A distributed electromagnetic (EM) wave filter, comprising:

a cavity;

upper and lower ground planes on top and bottom surfaces of the cavity, said upper and lower ground planes in electrical contact held at a single ground;

one or more resonators in said cavity between the upper and lower ground planes to define respective stripline transmission lines;

an input port coupled to a first one of said one or more resonators to receive an EM wave;

an output port coupled to a last one of said one or more resonators to output a filtered EM wave;

a first hole in said one or more resonators; and a first conductive structure that passes through said first hole substantially normal to said one or more resonators without touching said one or more resonators, wherein both ends of said first conductive structure are connected to the single ground.

2. The filter of claim 1, wherein said one or more resonators are approximately equidistant from said upper and lower ground planes within a dielectric media of uniform dielectric constant to define the stripline transmission line.

3. A distributed electromagnetic (EM) wave filter, comprising:

a cavity;

upper and lower ground planes on top and bottom surfaces of the cavity, said upper and lower ground planes in electrical contact held at a single ground;

one or more resonators in said cavity between the upper and lower ground planes that define respective transmission lines;

an input port coupled to a first one of said one or more resonators to receive an EM wave;

an output port coupled to a last one of said one or more resonators to output a filtered EM wave;

one or more holes in said one or more of said resonators; and one or more conductive structures that pass through said one or more holes substantially normal to said one or more resonators, wherein said EM wave propagates through said cavity to the output filtered EM wave, said EM wave being attenuated as a function of a width of said cavity, said one or more conductive structures reducing the effective width of said cavity between non-adjacent resonators thereby increasing the attenuation of the EM wave coupled between the non-adjacent resonators and the attenuation of the EM wave propagating through said cavity.

4. The filter of claim 3, wherein said one or more conductive structures do not effect the width between adjacent resonators.

5. The filter of claim 1, wherein said one or more resonators are parallel-coupled to each other.

6. The filter of claim 5, further comprising one or more conductive structures connected to the single ground spaced apart from and not between said resonators within the cavity.

7. The filter of claim 1, wherein said one or more resonators are direct-coupled to each other by respective sections of transmission line.

8. The filter of claim 7, further comprising one or more conductive structures between adjacent resonators within the cavity and connected to the single ground.

9. The filter of claim 1, further comprising a second hole in said one or more resonators and a second conductive structure that passes through said second hole substantially normal to said resonator without touching said one or more resonators, wherein both ends of said second conductive structure are connected to the single ground.

10. The filter of claim 1, wherein said one or more resonators including second and third resonators between the first resonator and the last resonator include at least one hole, said first conductive structure passing through the first hole in the second resonator and a second conductive structure passing through a second hole substantially normal to said third resonator without touching the resonators, wherein both ends of said second conductive structure are connected to the single ground.

11. The filter of claim 1, wherein said one or more resonators are planar resonators in said cavity between and in parallel with the upper and lower ground planes.

12. The filter of claim 11, wherein said conductive structure comprises a conductive via connected at opposite ends to said upper and lower ground planes and passing through said first hole substantially normal to said one or more resonators.

13. The filter of claim 1, wherein said one or more resonators are folded resonators normal to the upper and lower ground planes, each said folded resonator comprising at least first and second planar segments separated by a vertical distance and a vertical segment that connects one end of the first segment to one end of the second segment, wherein said first hole is in said first planar segment and a second hole is in said second planar segment, said first conductive structure passes through said first and second holes substantially normal to said first and second planar segments without touching said first or second planar segments, wherein opposite ends of said first conductive structure are connected to the upper and lower ground planes.

14. A distributed electromagnetic (EM) wave filter, comprising:

a cavity;

upper and lower ground planes on top and bottom surfaces of the cavity, said upper and lower ground planes in electrical contact held at a single ground;

one or more parallel-coupled planar resonators in said cavity between and in parallel with the upper and lower ground planes to define respective stripline transmission lines;

an input port coupled to a first one of said one or more resonators to receive an EM wave;

an output port coupled to a last one of said one or more resonators to output a filtered EM wave;

a first hole in one of said resonators; and a first conductive via connected at opposite ends to said upper and lower ground planes and passing through said first hole substantially normal to said resonator without touching the resonator.

15. The filter of claim 14, wherein each said of said resonators comprises a conductive via connected between said upper and lower ground planes and passing through a hole in said resonator without touching the resonator.

16. The filter of claim 14, wherein at least one of said resonators comprises a plurality of conductive vias connected between said upper and lower ground planes and passing through respective holes along the length of the resonator without touching the resonator.

17. A distributed electromagnetic (EM) wave filter, comprising:

a cavity;

upper and lower ground planes on top and bottom surfaces of the cavity, said upper and lower ground planes in electrical contact held at a single ground;

one or more parallel-coupled folded resonators in said cavity between and normal to the upper and lower ground planes to define respective stripline transmission lines, each said folded resonator comprising at least first and second planar segments opposed to each other in a spaced apart relationship and a vertical segment that connects one end of the first planar segment to one end of the second planar segment;

an input port coupled to a first one of said one or more resonators to receive an EM wave;

an output port coupled to a last one of said one or more resonators to output a filtered EM wave;

first hole in a segment selected from one the first or second planar segments or said vertical segment of one of said resonators; and a first conductive structure that passes through said first hole substantially normal to the segment without touching the segment, wherein both ends of the first conductive structure are connected to the single ground.

18. A distributed electromagnetic (EM) wave filter, comprising:

a cavity;

upper and lower ground planes on top and bottom surfaces of the cavity, said upper and lower ground planes in electrical contact held at a single ground;

one or more parallel-coupled folded resonators in said cavity between and normal to the upper and lower ground planes, each said folded resonator comprising at least first and second planar segments opposed to each other in a spaced apart relationship and a vertical segment that connects one end of the first planar segment to one end of the second planar segment;

an input port coupled to a first one of said one or more resonators to receive an EM wave;

an output port coupled to a last one of said one or more resonators to output a filtered EM wave;

a first hole in the first planar segment of one said folded resonator;

a second hole in the second planar segment of the one said folded resonator; and a vertical conductive via connected at opposite ends to said upper and lower ground planes that passes through the first and second holes in said first and second planar segments of the folded resonator substantially normal to said first and second planar segments.

19. A distributed electromagnetic (EM) wave filter, comprising:

a cavity;

upper and lower ground planes on top and bottom surfaces of the cavity, said upper and lower ground planes in electrical contact held at a single ground;

one or more parallel-coupled folded resonators in said cavity between and normal to the upper and lower ground planes, each said folded resonator comprising at least first and second planar segments opposed to each other in a spaced apart relationship and a vertical segment that comprises a pair of spaced apart vias that each connect one end of the first planar segment to one end of the second planar segment;

an input port coupled to a first one of said one or more resonators to receive an EM wave;

an output port coupled to a last one of said one or more resonators to output a filtered EM wave; and a horizontal ground strip that passes through the space between said spaced-apart vias of the vertical segment.

20. The filter of claim 19, further comprising an internal ground plane between said first and second planar segments and a side ground plane on a wall of said cavity opposite the pair of vias, said internal and side ground planes held at the single ground, said horizontal ground strip extending from the internal ground plane through the pair of vias to the side ground plane.

21. The filter of claim 17, wherein said vertical segment comprises a pair of spaced apart vias, further comprising an internal ground plane between said first and second planar segments and a side ground plane on a wall of said cavity opposite the pair of vias, said internal and side ground planes held at the single ground, wherein said first conductive structure comprises a vertical conductive via connected between upper, internal and lower ground planes that passes through the first hole in the first plane segment and a second hole in said second planar segment, and wherein a second conductive structure comprises a horizontal ground strip that extends from said internal ground plane through the pair of vias to the side ground plane.

22. The filter of claim 1, wherein said EM wave propagates through said cavity to the output filtered EM wave, said EM wave being attenuated as a function of a width of said cavity, said one or more conductive structures reducing the effective width of said cavity between non-adjacent resonators thereby increasing the attenuation of the EM wave coupled between the non-adjacent resonators and the attenuation of the EM wave propagating through said cavity.

23. The filter of claim 14, wherein said EM wave propagates through said cavity to the output filtered EM wave, said EM wave being attenuated as a function of a width of said cavity, said one or more conductive structures reducing the effective width of said cavity between non-adjacent parallel-coupled planar resonators thereby increasing the attenuation of the EM wave coupled between the non-adjacent parallel-coupled planar resonators and the attenuation of the EM wave propagating through said cavity.

24. The filter of claim 17, wherein said EM wave propagates through said cavity to the output filtered EM wave, said EM wave being attenuated as a function of a width of said cavity, said one or more conductive structures reducing the effective width of said cavity between non-adjacent parallel-coupled folded resonators thereby increasing the attenuation of the EM wave coupled between the non-adjacent parallel-coupled folded resonators and the attenuation of the EM wave propagating through said cavity.

* * * * *